United States Patent [19]

Strickland

[11] 4,159,097

[45] Jun. 26, 1979

[54] TIE HAVING INTEGRALLY MOLDED SLEEVE

[75] Inventor: James K. Strickland, Jacksonville, Fla.

[73] Assignee: Strickland Systems Inc., Jacksonville, Fla.

[21] Appl. No.: 722,431

[22] Filed: Sep. 13, 1976

[51] Int. Cl.[2] ..... E04G 17/08

[52] U.S. Cl. ..... 249/40; 249/43; 249/190; 249/213

[58] Field of Search ..... 249/40, 42–46, 249/190, 191, 213, 214, 216, 217; 264/242, 274

[56] References Cited

U.S. PATENT DOCUMENTS

| | | | |
|---|---|---|---|
| 954,636 | 4/1910 | Kurman | 249/43 |
| 1,301,959 | 4/1919 | Merrick | 249/43 |
| 2,314,866 | 3/1943 | Bosco | 249/43 |
| 2,904,845 | 9/1959 | Sperry | 264/242 |
| 3,057,034 | 10/1962 | Helmick | 249/213 |
| 3,437,309 | 4/1969 | Tausanovitch | 249/43 |
| 3,933,332 | 1/1976 | Lovisa et al. | 249/43 |

FOREIGN PATENT DOCUMENTS

| | | | |
|---|---|---|---|
| 1074965 | 7/1967 | United Kingdom | 249/43 |

*Primary Examiner*—Roy Lake
*Assistant Examiner*—John McQuade
*Attorney, Agent, or Firm*—Schuyler, Birch, Swindler, McKie & Beckett

[57] ABSTRACT

A tapered tie for use in concrete form tying apparatus comprising a threaded steel rod having a longitudinally tapering protective plastic sleeve placed over the central portion thereof.

9 Claims, 2 Drawing Figures

TIE HAVING INTEGRALLY MOLDED SLEEVE

BACKGROUND OF THE INVENTION

1. Field of the Invention

This invention relates generally to apparatus for tying concrete form panels together, and more specifically, to a tapered tie for use in such apparatus.

2. Description of the Prior Art

Various devices are known in the construction industry for holding concrete form panels together to adequately receive and support concrete poured inside them to form a wall or other structural unit. One example of such a device is shown in U.S. patent application Ser. No. 576,862, filed May 12, 1975 by James K. Strickland et al, now Pat. No. 4,044,986, and assigned to the assignee of the present application. One feature of the apparatus shown in this prior application is the use of a tapered tie to hold the concrete form panels together. Such ties are conventionally made from a plurality of steel rods threaded together or cast into a one-piece steel tie to have sufficient strength to hold the form panels together and to withstand the stresses imposed upon the ties.

A number of disadvantages are associated with ties fabricated from steel. When such ties are embedded inside the concrete column for the necessary length of time needed for the column to set, the ties sometimes rust or might have been rusty when first emplaced, thereby leaving rust spots on the completed concrete structure marring its appearance. Furthermore, steel ties are extremely heavy which increases their shipping weight and makes them difficult to handle. In addition, since such ties must often have a tapered shape, special casting equipment is needed to make the ties. If it were desired to vary the degree of the taper or otherwise change the shape of the steel tie, new and expensive casting equipment is required for each shape. Conventional steel ties are thus expensive to fabricate and, practically speaking, have a limited geometric capability.

SUMMARY OF THE INVENTION

Accordingly, it is an object of the present invention to overcome the above-noted disadvantages of the prior art ties by providing a tie for use in holding concrete form panels together which is protected from rust and will not thereby stain or otherwise mar the finished concrete structure.

It is a further object of the present invention to provide a tie for use in holding concrete form panels together which is relatively inexpensive, light and has a substantially unlimited geometric capability.

These and other objects of the present invention are accomplished by providing a tie comprising an elongated, threaded steel rod having a central portion and opposed outer portions extending therefrom. The outer portions of the rod may be attached to conventional threaded anchoring means on a concrete form tying apparatus to hold the form panels together in a known manner. A protective plastic cover is placed over the central portion of the rod to protect the rod from corrosion, thereby preventing rust stains on the finished concrete structure. The plastic cover preferably comprises an elongated tapered sleeve which is injection molded onto the steel rod.

BRIEF DESCRIPTION OF THE DRAWINGS

The novel features of the invention are set out with particularity in the appended claims, but the invention will be understood more fully and clearly from the following detailed description of a preferred embodiment of the invention as set forth in the accompanying drawings, in which:

DESCRIPTION OF A PREFERRED EMBODIMENT

Figure 1:
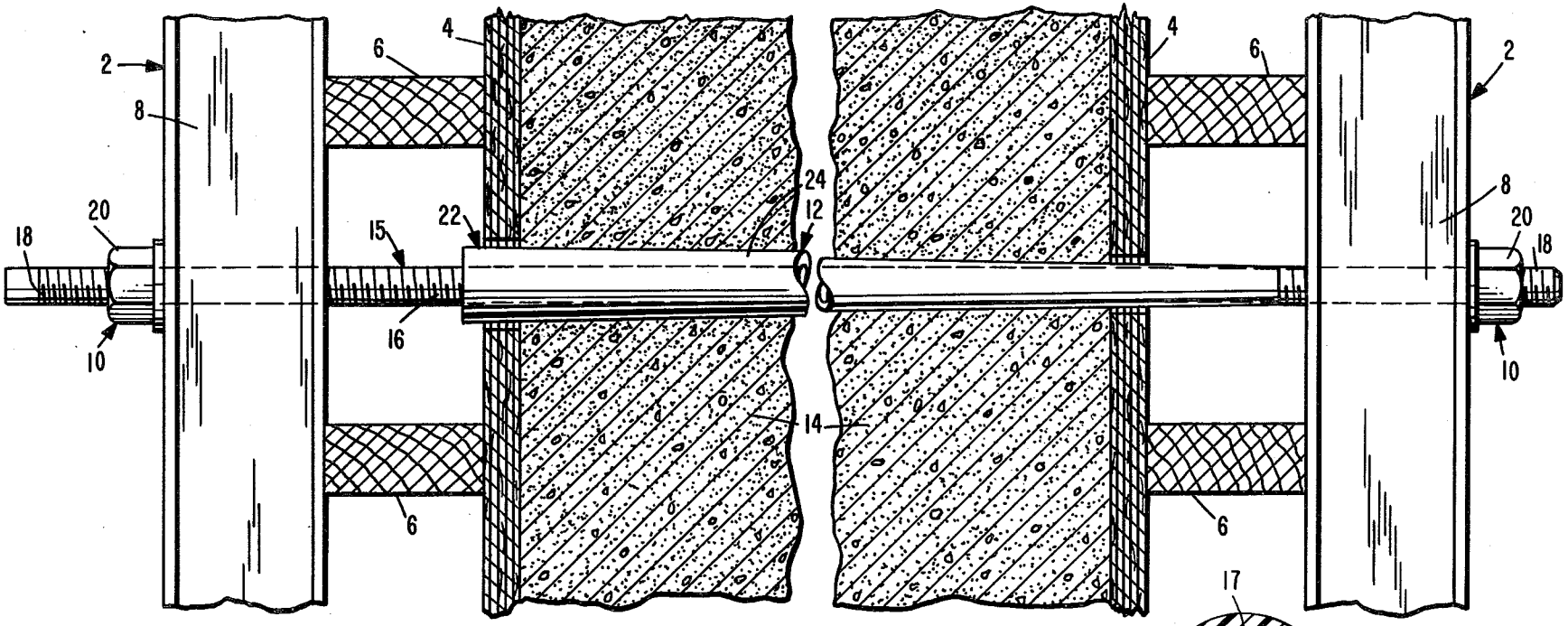
FIG. 1 represents a side view of a typical installation of the tapered tie according to the present invention in a conventional concrete form panel tying apparatus.
Figure 3:
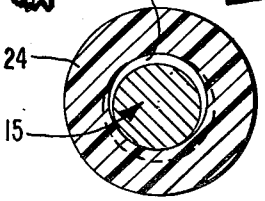
FIG. 3 is a cross sectional view taken along lines 3—3 of FIG. 2.

FIG. 1 illustrates, insofar as pertinent, the concrete form panel tying apparatus which is the subject matter of the assignee's copending application, U.S. Ser. No. 576,862, having a pair of substantially identical opposed concrete form panels 2. These form panels 2, of any desired height and width, may suitably comprise plywood panels 4 braced with horizontal wooden walers 6 and vertical steel channel walers 8. Releasably attached to the vertical walers 8 are tie anchoring units 10 for releasably clamping the form panels 2 to ties 12 extending through the concrete structure 14, which here is illustrated as a portion of a vertical wall.

The ties 12 according to the present invention comprise an elongated steel rod 15 having a central portion 16 with opposed outer portions 18 extending outwardly therefrom. Rod 15 is a standard steel rod having external threads 17 over its entire length, threads 17 having a substantially constant root diameter 26, such rods being readily available with no special casting equipment needed to form them. The outer portions 18 of the rod 15 are engaged by the clamping units 10 to hold the form panels 2 together. Clamping units 10 comprise a nut and washer 20 threaded onto the outer sections 18 of the rod 15 to bear against the outer surface of the vertical channel 8. Although a nut and washer 20 has been illustrated as the clamping unit 10, it should be understood that other types of releasable clamping units, such as those shown in the assignee's copending application, could also be utilized as the clamping unit 10.

Figure 2:
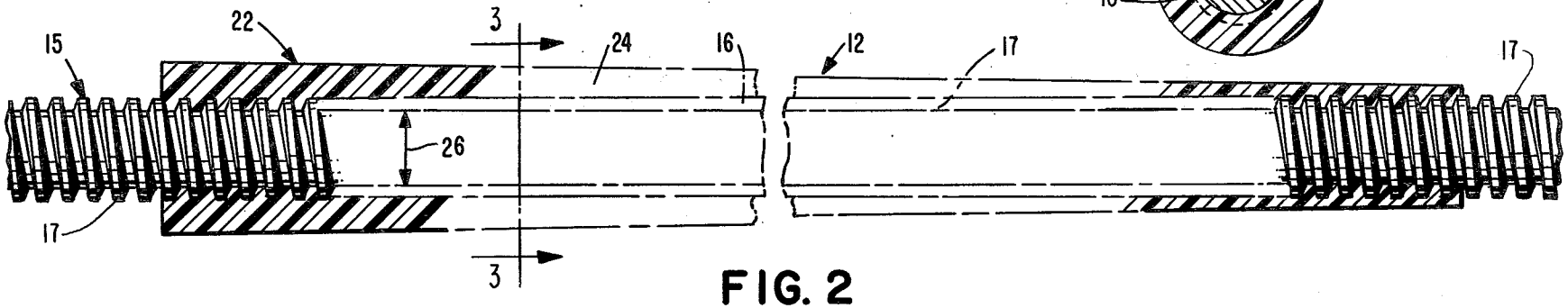
FIG. 2 is a cross sectional view of the tapered tie according to the present invention.

Tie 12 further includes a protective plastic cover 22 which is injection molded onto the central section 16 of the steel rod 15. Protective cover 22 extends substantially over the entire central section 16, comprising approximately two thirds of the entire length of the rod, so that the steel rod 15, when installed through the concrete structure 14, never comes into contact with the structure. Furthermore, protective cover 22 preferably comprises an elongated cylindrical sleeve 24 having an inner diameter approximately the same as the root diameter 26 of the steel rod 15 and conforming to the configuration of external threads 17. Sleeve 24 is longitudinally tapered by virtue of a steadily decreasing wall thickness as illustrated in FIG. 2. Tapering of the sleeve 24 allows the tie 12 to be more easily removed from the concrete structure 14 after the concrete has hardened.

The tie 12 according to the present invention has many advantages. It prevents rust stains on the concrete structure 14 because only the plastic cover 22 comes into contact with the structure. The protective cover 22 also serves to encase and protect the steel rod 15 itself, thereby inhibiting the formation of rust on the rod 15 in the first place. In addition, use of a tapered plastic sleeve 22 on an easily obtainable, uniform steel rod 15 results in a tie 12 which is cheaper to fabricate and lighter than conventional steel ties. Furthermore, tie 12 has practically an unlimited geometric capability since the plastic cover 22 may easily be formed with varying degrees of taper or any other desired shapes by the use of relatively cheap plastic forming equipment, rather than having to use the expensive metal casting equipment needed to form conventional tapered steel ties. Typically, a tie 12 fabricated according to the instant invention is 30 percent cheaper than a standard steel tie.

Although the present invention has been illustrated in terms of a preferred embodiment, numerous modifications may be made without departing from the true spirit and scope of the invention. For example, it is apparent that the steel rod 15 could be threaded over only its outer portions 18 if desired and need not necessarily be of a uniform diameter. The scope of the invention is therefore to be limited only by the appended claims.

I claim:

1. A unitary tie for holding form panels in spaced apart relation for receiving a hardenable material between said form panels to form a structure, comprising:

(a) an elongated rod of substantially uniform diameter and threaded throughout its length having an elongated central section to extend between and through the form panels and opposed outer sections extending outwardly from each end of said central section, said outer sections having an engagement portion capable of releasable engagement with anchoring means for anchoring said rod outwardly of said form panels in an operative orientation of said rod with said central section extending between and through said form panels; and (b) a protective plastic sleeve covering and integrally secured along its length to said rod to protect and be fixed against movement relative to said rod, said sleeve having a longitudinally tapered outer surface extending longitudinally over substantially the entire length of said central section to extend through the form panels so that said central section does not contact said hardenable material placed inside the form panels and said unitary tie is removable only as a unitary unit including both said rod and said sleeve from said structure.

2. A unitary tie according to claim 1 wherein said sleeve is integrally molded to said rod.

3. Combination concrete form panels and tying apparatus comprising:

a pair of form panels in spaced apart relation for receiving a hardenable material between said form panels to form a structure, an elongated rod having an elongated central section with a length sufficient to extend between and through said spaced apart form panels and opposed outer sections extending outwardly from each end of said central section, said outer sections each having an engagement portion capable of releasable engagement with anchoring means for anchoring said rod outwardly of said form panels in an operative orientation of said rod with said central section extending between and through said form panels, a protective plastic sleeve covering and integrally secured along its length to said rod to protect and be fixed against movement relative to said rod, said sleeve having a longitudinally tapered outer surface and enclosing substantially the entire length of said central section to extend through said form panels so that said central section does not contact the hardenable material placed inside said form panels, said rod and said sleeve integral with said rod being removable only as a unitary unit from the structure, and anchoring means engaging the engagement portions of said outer sections for anchoring said rod outwardly of said form panels.

4. Apparatus according to claim 3 wherein said sleeve is integrally molded to said rod.

5. Apparatus according to claim 3 wherein each of said outer sections has a threaded portion for engagement with threaded anchoring means for anchoring said rod outwardly of the form panels.

6. Apparatus according to claim 3 wherein said rod is threaded over its entire length.

7. Combination concrete form panel and tying apparatus comprising:

at least one form panel providing an inner surface for retaining a hardenable material in forming a structure, an elongated rod extending through said form panel having an outer section and providing an engagement portion capable of releasable engagement with anchoring means for anchoring said rod outwardly of said form panel, a protective plastic sleeve covering and integrally secured along its length to an inner portion of said rod to protect and be fixed against movement relative to said rod, said sleeve having a longitudinally tapered outer surface and enclosing substantially the entire length of said inner portion, said sleeve extending through said form panel so that said inner portion of said rod does not contact the hardenable material retained against said form panel inner surface, said rod and said sleeve integral with said rod being removable only as a unitary unit from the structure, and anchoring means engaging the engagement portion of said outer section for anchoring said rod outwardly of said form panel.

8. Apparatus as recited in claim 7 wherein said rod is externally threaded throughout its length and said sleeve has an internal bore extending therethrough conforming to the external threads on said rod.

9. Apparatus according to claim 7 wherein said sleeve is integrally molded to said rod.

* * * * *